US005080555A

United States Patent [19]

Kempinger

[11] Patent Number: 5,080,555

[45] Date of Patent: Jan. 14, 1992

[54] TURBINE SUPPORT FOR GAS TURBINE ENGINE

[75] Inventor: Gilbert H. Kempinger, Indianapolis, Ind.

[73] Assignee: General Motors Corporation, Detroit, Mich.

[21] Appl. No.: 614,430

[22] Filed: Nov. 16, 1990

[51] Int. Cl.[5] ..... F01D 25/16

[52] U.S. Cl. ..... 415/142; 415/108; 415/136; 415/138; 415/182.1; 60/39.08

[58] Field of Search ..... 415/115, 116, 134, 136, 415/138, 139, 142, 177, 182.1, 108; 60/39.08

[56] References Cited

U.S. PATENT DOCUMENTS

| | | | |
|---|---|---|---|
| 2,439,447 | 4/1998 | Buck et al. | 415/136 |
| 2,497,049 | 2/1950 | Soderberg | 415/134 |
| 2,941,781 | 6/1960 | Boyom | 415/142 |
| 4,197,702 | 4/1980 | Robertson | 415/142 |
| 4,979,872 | 12/1990 | Myers et al. | 415/142 |

*Primary Examiner*—Edward K. Look
*Assistant Examiner*—Christopher M. Verdier
*Attorney, Agent, or Firm*—Saul Schwartz

[57] ABSTRACT

A turbine support for reacting structural loads from a rotor bearing cage to a case of a gas turbine engine. The turbine support includes a homogeneous main casting and a rotor bearing cage. The main casting has concentrically arranged inner, intermediate and outer walls. The bearing cage is radially inboard and a rigid appendage of the inner wall. The inner and intermediate walls define therebetween a longitudinal segment of the annular hot gas flow path of the engine. The outer wall is bolted to the engine case. The inner wall is connected to the intermediate wall by a plurality of generally radially oriented, angularly separated inner load bearing struts of the main casting. The outer wall is connected to the intermediate wall by a plurality of radially oriented, angularly separated outer load bearing struts of the main casting. The outer struts are offset from the inner struts so that the portions of the intermediate wall between adjacent pairs of inner and outer struts define cantilever springs which accommodate relative thermal growth in the turbine support occasioned by temperature gradients to which the turbine support is exposed.

2 Claims, 2 Drawing Sheets

TURBINE SUPPORT FOR GAS TURBINE ENGINE

This invention was made in the course of work under a contract or subcontract with the United States Department of Defense.

FIELD OF THE INVENTION

This invention relates to turbine supports in gas turbine engines.

BACKGROUND OF THE INVENTION

In a typical gas turbine engine, an annular hot gas flow path around a longitudinal centerline of the engine extends from a combustor of the engine to an exhaust at the aft end of the engine. Between the combustor and the exhaust, the hot gas flow path traverses at least one stage of turbine blades on a high pressure rotor rotatable about the longitudinal centerline of the engine. A turbine support reacts structural loads from a rotor bearing cage radially inboard of the hot gas flow path to an engine case radially outboard of the hot gas flow path. The turbine support is necessarily subjected to a significant thermal gradient between the hot gas flow path and the engine case. To the end of minimizing the effect of the thermal gradient, turbine supports have been proposed in which the load bearing struts between the rotor bearing cage and the engine case are separate from the internal walls or partitions of the support which define the inner and outer boundaries of the hot gas flow path and are directly exposed to the hot gas therein. The load bearing struts are shielded from the hot gas by airfoil-shaped shrouds between the partitions. In other turbine supports, the effect of the thermal gradient is minimized by orienting the load bearing struts tangent to a circular or cylindrical rotor bearing cage. And in still another proposal, the effect of the thermal gradient is minimized by orienting some of the load bearing struts radially and some tangent to the bearing cage. A turbine support according to this invention has a main casting with cantilever spring wall segments which flex to minimize the effect of the thermal gradient.

SUMMARY OF THE INVENTION

This invention is a new and improved turbine support for a gas turbine engine. The turbine support according to this invention includes a main casting having an outer wall centered on a longitudinal centerline of the engine and adapted for connection to the engine case, an intermediate wall inside and concentric with the outer wall, an inner wall inside and concentric with the intermediate wall and adapted for connection to a rotor bearing cage, a plurality of inner load bearing struts integral with and between the inner and the intermediate walls, and a plurality of outer load bearing struts integral with and between the intermediate and the outer walls. The inner and the intermediate walls define the boundaries of the hot gas flow path where the latter traverses the turbine support. The inner and outer struts are oriented generally radially relative to the longitudinal centerline and the outer struts are angularly offset relative to the inner struts by about one half the angular interval between the inner struts. The portions of the intermediate wall between adjacent pairs of inner and outer struts define cantilever springs which flex to accommodate relative thermal growth occasioned by thermal gradients to which the turbine support is exposed. In a preferred embodiment, the inner struts are hollow and open through each of the intermediate and inner walls of the main casting and define shielded passages across the hot gas flow path for service tubes and the like.

DESCRIPTION OF A PREFERRED EMBODIMENT

Figure 1:
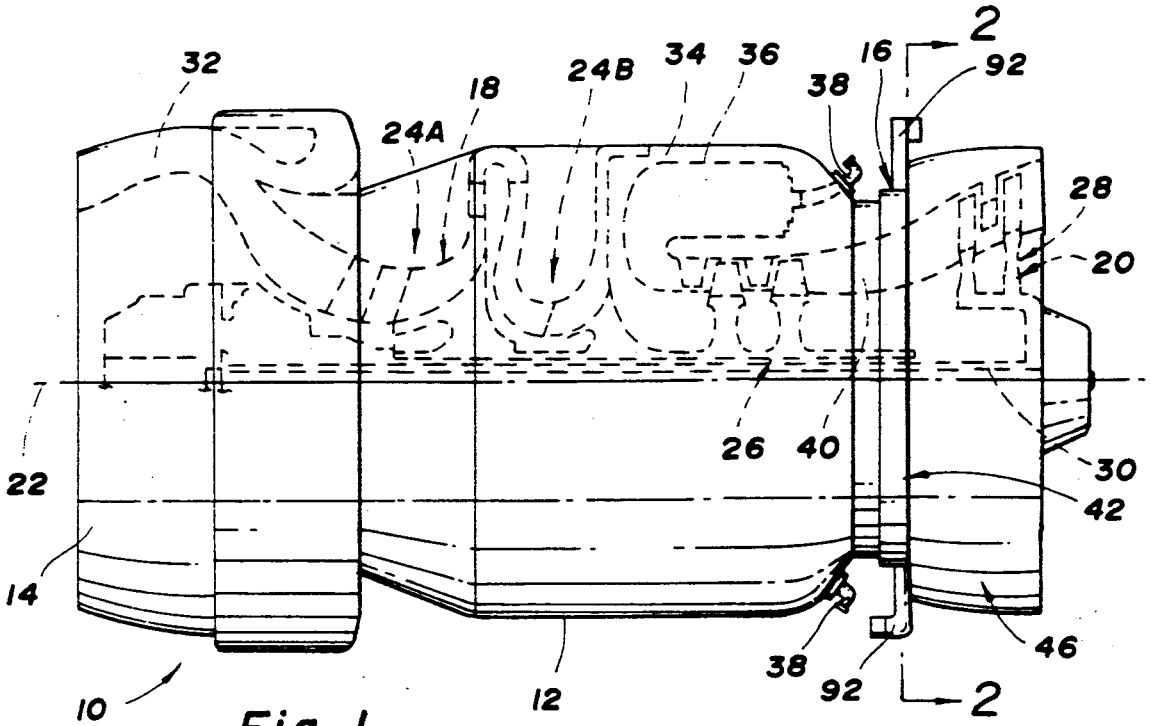
FIG. 1 is a side elevational view of a gas turbine engine having a turbine support according to this invention.

Referring to FIG. 1, a turbo-shaft gas turbine engine (10) has a case (12), an inlet particle separator (14) rigidly connected to the case (12) and defining the front end of the engine, and a turbine support (16) according to this invention rigidly connected to the case (12) at the opposite end of the latter from the inlet particle separator and defining the aft or rear end of the engine. The rotating group of the engine (10), schematically illustrated in broken line in FIG. 1, is conventional and includes a high pressure or gasifier rotor (18) and a low pressure or power turbine rotor (20) each aligned on a longitudinal centerline (22) of the engine. The high pressure rotor includes a pair of centrifugal compressors (24A–B) in flow series behind the inlet particle separator and a two stage high pressure turbine wheel (26). The low pressure rotor (20) includes a two stage power turbine wheel (28) and a tubular, front take-off output shaft (30) extending forward through the center of the high pressure rotor.

The inlet particle separator (14) defines an annular inlet airflow path (32) between the front end of the engine and the inlet of the first centrifugal compressor (24A). The first centrifugal compressor (24A) discharges into the inlet of the second centrifugal compressor (24B) which discharges into a compressed air plenum (34) in the case (12) around an annular, reverse flow combustor (36). Fuel is injected into the combustor (36) through a plurality of nozzles (38) and a continuous stream of hot gas motive fluid is generated in the combustor (36) in the usual fashion. The hot gas motive fluid flows aft from the combustor (36) in an annular hot gas flow path (40) of the engine centered around the longitudinal centerline (22). The hot gas flow path (40) traverses two stages of turbine blades on the high pressure turbine wheel (26), the turbine support (16), and the two stages of turbine blades on the low pressure turbine wheel (28). After expanding through the several turbine blade stages, the hot gas motive fluid exhausts directly or through exhaust suppression apparatus, not shown.

Figure 2:
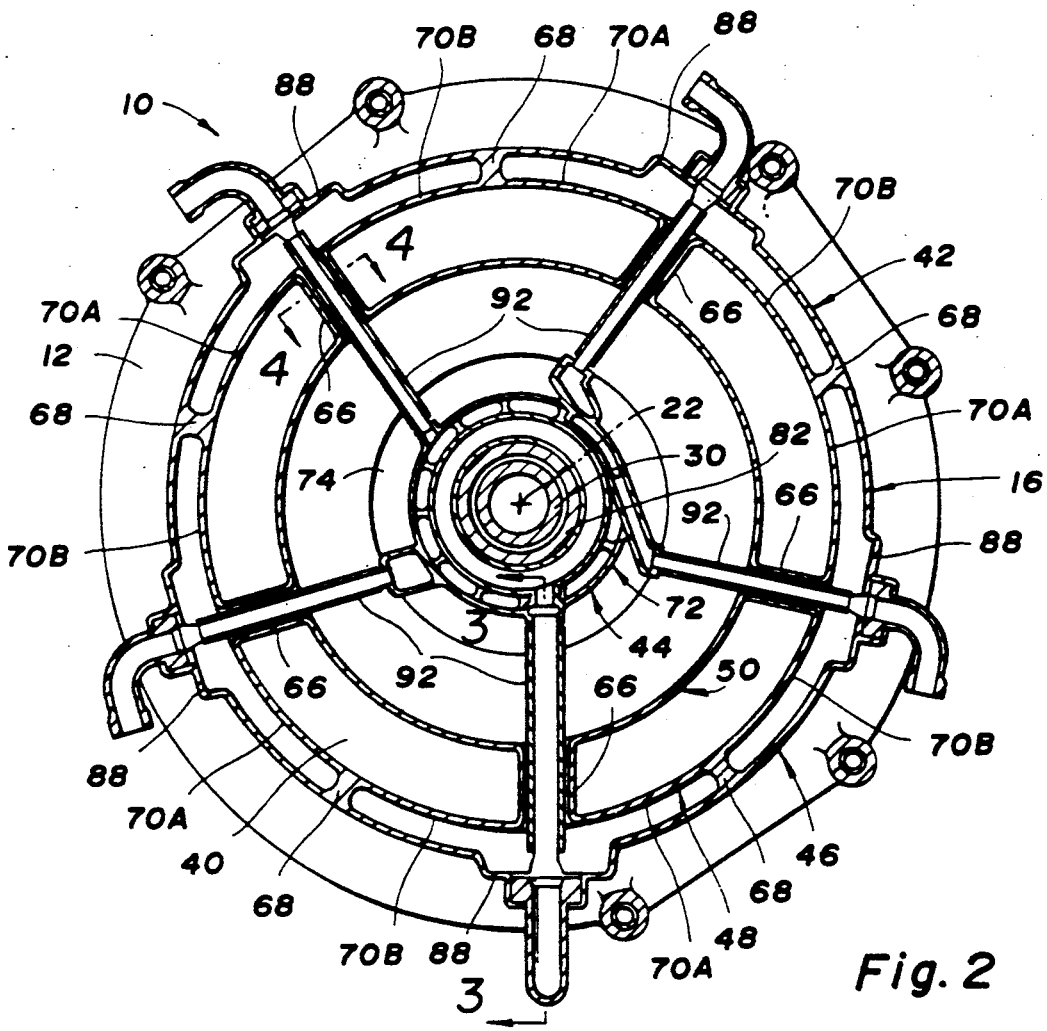
FIG. 2 is an enlarged sectional view taken generally along the plane indicated by lines 2—2 in FIG. 1.
Figures 3, 4:
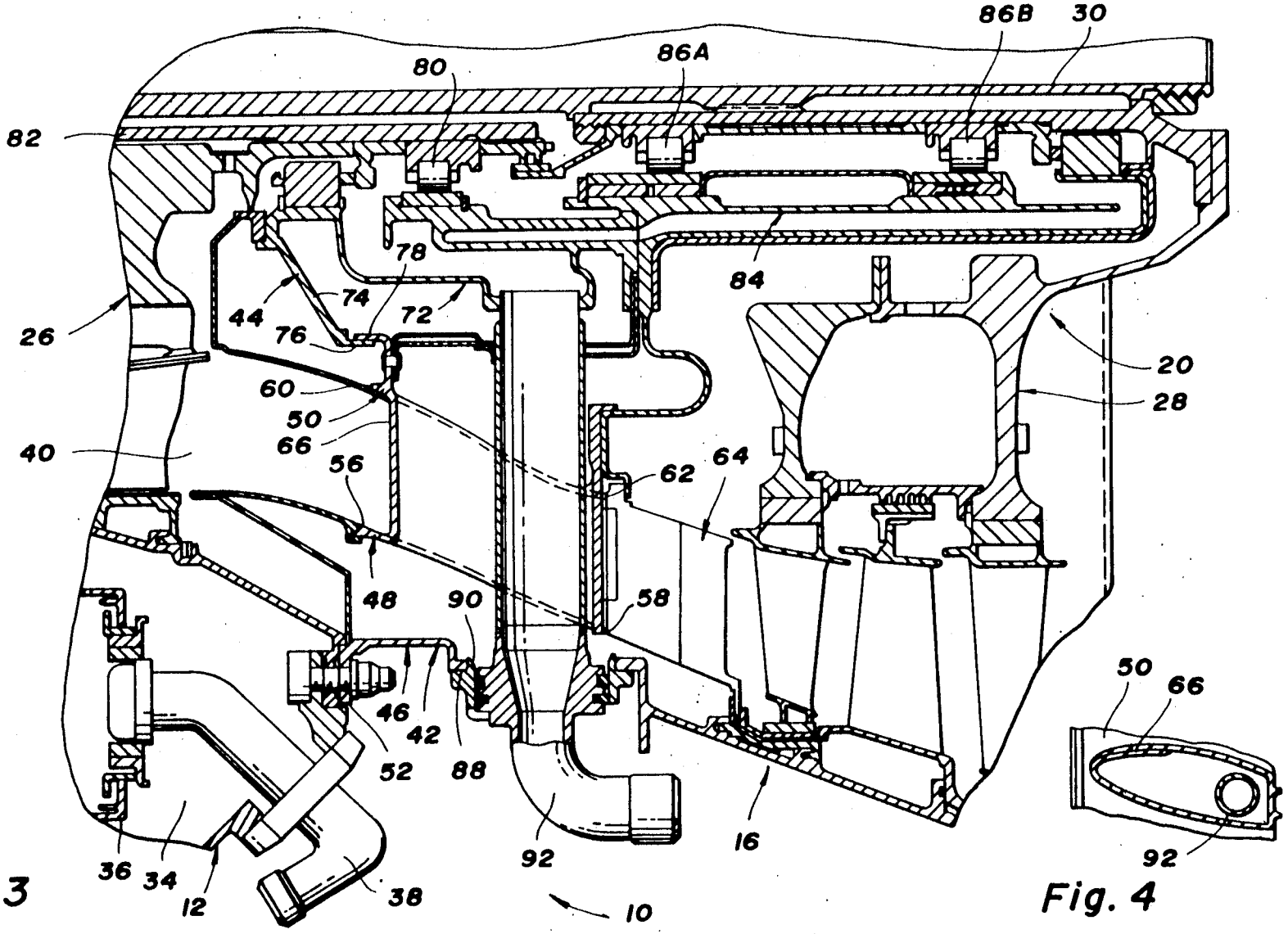
FIG. 3 is an enlarged sectional view taken generally along the plane indicated by lines 3—3 in FIG. 2.
FIG. 4 is an enlarged sectional view taken generally along the plane indicated by lines 4—4 in FIG. 2.

Referring to FIGS. 1–3, the turbine support (16) according to this invention includes a main casting (42) and a high pressure rotor bearing cage (44). The main casting (42) is a homogeneous metal casting and includes a bell-shaped outer wall (46) centered on the longitudinal centerline (22), a bell-shaped intermediate wall (48) radially inboard of and concentric with the outer wall, and a bell-shaped inner wall (50) radially inboard of and concentric with the intermediate wall (48). The outer wall extends aft beyond the two blade stages of the low pressure turbine wheel (28) and has an annular flange (52) at its forward end whereat the main casting is rigidly bolted to the case (12) of the engine.

The intermediate wall (48) flares or expands outward from a forward or front edge (56) generally in the plane of the flange (52) on the outer wall (42) to an aft edge (58). The inner wall (50) flares outward from a forward or front edge (60) generally in the plane of the flange (52) on the outer wall and the front edge (56) of the intermediate wall to an aft edge (62) generally in the same plane as the aft edge of the intermediate wall. A low pressure turbine nozzle (64) is disposed between the aft edges (58),(62) of the intermediate and inner walls and the first stage of turbine blades on the low pressure turbine wheel (28). The intermediate wall (48) defines the outside boundary of the hot gas flow path (40) where the latter traverses the turbine support(16). The inner wall (50) defines the inside boundary of the hot gas flow path (40) where the latter traverses the turbine support (16).

As seen best in FIGS. 2–4, the inner wall (50) is rigidly connected to the intermediate wall (48) by a plurality of inner load bearing struts (66) which are part of the main casting and, therefore, integral with each of the inner and intermediate walls. Each inner strut (66) is oriented generally radially relative to the longitudinal centerline (22) and bridges the hot gas flow path (40) between the inner and intermediate walls. Each inner strut is hollow, generally airfoil-shaped, and open at opposite ends through the intermediate and inner walls. Preferably, the inner struts are spaced at about equal angular intervals around the longitudinal centerline (22).

The intermediate wall (48) is rigidly connected to the outer wall (46) by a plurality of solid, outer load bearing struts (68) which are part of the main casting and, therefore, integral with each of the intermediate and outer walls. The number of outer struts equals the number of inner struts. Each outer strut (68) is oriented radially relative to the longitudinal centerline (22) and bridges the annular gap between the intermediate and outer walls. The outer struts are separated by the same angular interval separating the inner struts but are angularly indexed or offset from the inner struts by about one-half the angular interval between the inner struts so that the outer struts are about mid-way between the inner struts, FIG. 2. The sections of the intermediate wall (48) between adjacent pairs of inner and outer struts (66),(68) define a plurality of cantilever springs (70A–B).

The high pressure bearing cage (44) of the turbine support (16) includes a generally cylindrical, honeycombed body (72) centered on the longitudinal centeline (22) of the engine and an outwardly flaring skirt (74) integral with the cylindrical body. The skirt (74) has a flange (76) which is brazed or otherwise rigidly connected to an annular flange (78) of the main casting (42) radially inboard of the inner wall (50) such that the bearing cage (44) is a rigid appendage of the main casting (42). A high pressure rotor bearing (80) has an outer race in the cage (44) and an inner race on a tubular extension (82), FIG. 3, of the high pressure rotor (18) whereby the aft end of the high pressure rotor is supported on the engine case by the turbine support (16) for rotation about the longitudinal centerline (22).

A low pressure rotor bearing cage (84) butts against the aft end of the high pressure bearing cage (44) and is rigidly connected to the latter. A pair of low pressure rotor bearings (86A–B) each have an outer race in the low pressure bearing cage (84) and an inner race connected to the tubular, front take-off, output shaft (30) whereby the aft end of the low pressure rotor (20) is supported on the engine case (12) by the turbine support (16) for rotation about the longitudinal centerline (22).

The outer wall (46) of the turbine support (16) has a plurality of exposed, flat bosses (88) aligned with respective ones of the inner struts (66). Each boss (88) as an access port therein through the outer wall (46), only a representative access port (90) being illustrated in FIG. 3. Respective ones of a plurality of non-load bearing service tubes (92) extend through the access ports in the outer wall (46) and through corresponding ones of the hollow inner struts (66). The inboard ends of the service tubes are connected to appropriate passages in the honeycomb body (72) of the high pressure rotor bearing cage (44) and are shielded by the inner struts against direct exposure to the hot gas motive fluid in the hot gas flow path (40). Cooling air may be ducted to the interiors of the inner struts to further protect the service tubes. Each service tube has a collar or the like adapted for rigid attachment to a corresponding one of the bosses (88) whereby the service tubes are retained on the engine. The service tubes may be for oil scavenging from around the bearings (80),(86A–B), for ducting cooling or buffer air to seals associated with the bearings, or the like.

The angular offset relationship between the inner and outer struts (66),(68) which define the cantilever springs (70A–B) is an important feature of this invention. During engine operation, the inner struts (66) and intermediate wall (48) are exposed directly to the hot gas motive fluid and are at high temperature. The outer struts (68) and outer wall (46) are in significantly cooler environments of the engine and, accordingly, experience significantly lower temperature than the inner struts and intermediate wall. The temperature gradients induce thermal growth of the intermediate wall and inner struts relative to the outer wall and outer struts. Such thermal growth is accompanied by flexure of the cantilever springs (70A–B) which accommodates thermal growth without inducement of objectionably high stress concentrations in the main casting.

What is claimed is:

1. In a gas turbine engine, a turbine support comprising:

a homogeneous main casting including an outer wall centered around a longitudinal centerline of said engine and adapted for rigid attachment to a structural case of said engine, an intermediate wall centered around said longitudinal centerline radially inboard of said outer wall and separated from said outer wall by a first annular gap, an inner wall centered around said longitudinal centerline radially inboard of said intermediate wall and separated from said intermediate wall by a second annular gap defining a longitudinal segment of an annular hot gas flow path of said engine, a plurality of inner load bearing struts integral with each of said intermediate and said inner walls disposed generally radially relative to said longitudinal centerline and bridging said second annular gap at predetermined angular intervals around said main axis, a corresponding plurality of outer load bearing struts integral with each of said intermediate and said outer walls disposed radially relative to said longitudinal centerline and bridging said first annular gap, each of said outer load bearing struts being angularly offset relative to each of said inner load bearing struts by about one half of said predetermined angular interval between adjacent ones of said inner load bearing struts so that said intermediate wall defines a plurality of cantilever springs between adjacent pairs of said inner and said outer load bearing struts, a rotor bearing cage centered on said longitudinal centerline radially inboard of said inner wall, and means rigidly connecting said rotor bearing cage to said inner wall.

2. The turbine support recited in claim 1 wherein each of said inner load bearing struts is hollow and open through each of said inner and said intermediate walls to define a shielded radial passage across said longitudinal segment of said hot gas flow path of said engine.

* * * * *